US007347416B2

(12) United States Patent
Diews et al.

(10) Patent No.: US 7,347,416 B2
(45) Date of Patent: Mar. 25, 2008

(54) APPARATUS FOR TRANSPORTING A PRINTING MATERIAL SHEET

(75) Inventors: Michael Diews, Birkenau (DE); Hendrik Frank, Heidelberg (DE); Alexander Matern, Neulussheim (DE); Thomas Schaeffer, Mauer (DE); Ralf Wadlinger, Hockenheim (DE); Rolf Waldherr, Sinsheim (DE); Ivonne Schleweis, Mühlhausen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 516 days.

(21) Appl. No.: 10/926,415

(22) Filed: Aug. 25, 2004

(65) Prior Publication Data

US 2005/0067770 A1 Mar. 31, 2005

(30) Foreign Application Priority Data

Sep. 30, 2003 (DE) ..... 103 45 331.8

(51) Int. Cl.
*B65H 29/04* (2006.01)

(52) U.S. Cl. ..... 271/204; 271/205; 271/84; 271/85

(58) Field of Classification Search ..... 271/198, 271/204, 205, 82, 84, 85; 101/181, 183, 101/232; 318/38, 135
See application file for complete search history.

(56) References Cited

U.S. PATENT DOCUMENTS

| | | | | |
|---|---|---|---|---|
| 4,408,525 | A | 10/1983 | Rebel | |
| 4,524,964 | A * | 6/1985 | Jamieson, Jr. | 271/204 |
| 5,193,458 | A | 3/1993 | Keller | |
| 6,240,843 | B1 | 6/2001 | Krüger et al. | |
| 6,923,119 | B1 * | 8/2005 | Frank | 101/232 |

FOREIGN PATENT DOCUMENTS

| | | |
|---|---|---|
| DE | 25 01 963 A1 | 12/1975 |
| DE | 25 20 231 A1 | 11/1976 |
| DE | 80 34 521 U1 | 5/1981 |
| DE | 197 48 870 A1 | 12/1998 |
| DE | 100 13 136 A1 | 10/2000 |
| EP | 0 907 515 B1 | 4/1999 |
| GB | 1003838 | 9/1965 |

* cited by examiner

*Primary Examiner*—David H Bollinger
(74) *Attorney, Agent, or Firm*—Laurence A. Greenberg; Werner H. Stemer; Ralph E. Locher

(57) ABSTRACT

An apparatus for transporting a printing material sheet includes a holding crossmember for holding the printing material sheet and a traveling-wave motor for driving the holding crossmember. The traveling-wave motor has a first traveler and a second traveler for mounting the holding crossmember. The holding crossmember is mounted through a spring suspension. The spring suspension can be, for example, a flexible joint in the form of a flexible bellows.

13 Claims, 3 Drawing Sheets

APPARATUS FOR TRANSPORTING A PRINTING MATERIAL SHEET

BACKGROUND OF THE INVENTION

Field of the Invention

The present invention relates to an apparatus for transporting a printing material sheet, which includes a holding crossmember for holding the printing material sheet and a traveling-wave motor for driving the holding crossmember. The traveling-wave motor has a first traveler and a second traveler for mounting the holding crossmember.

Such an apparatus is described, for example, in German Published, Non-Prosecuted patent application DE 197 48 870 A1 corresponding to European Patent 0 881 182 B1 and in European Patent 0 907 515 B1, corresponding to U.S. Pat. No. 6,240,843 to Krueger et al., the disclosures of which are hereby incorporated herein by reference in their entirety. In the case of the apparatus described in EP 0 907 515 B1, the holding crossmember is attached to the rotors of the traveling-wave motor through joints so that, by changing the position of one rotor relative to the other rotor, a diagonal register correction of the printing material sheet can be made.

In the case of the holding crossmember attached to the rotors, however, there is a problem: in the event of a malfunction or a failure of one of the rotors, the holding crossmember can get into an undefined skewed position, in which a collision between the holding crossmember and other machine parts is no longer ruled out.

SUMMARY OF THE INVENTION

It is accordingly an object of the invention to provide an apparatus for transporting a printing material sheet that overcomes the hereinafore-mentioned disadvantages of the heretofore-known devices of this general type and that is particularly safe in the event of an accident.

With the foregoing and other objects in view, there is provided, in accordance with the invention, an apparatus for transporting a printing material sheet, including a holding crossmember for holding the printing material sheet, a traveling-wave motor operatively associated with the crossmember for driving the holding crossmember, the traveling-wave motor having a first rotor or traveler and a second rotor or traveler for mounting the holding crossmember, and a spring suspension movably mounting the holding crossmember to the first and second travelers.

With the objects of the invention in view, there is also provided an apparatus for transporting a printing material sheet, including a holding crossmember for holding the printing material sheet, the holding crossmember being a sheet gripper bar having first and second ends, a traveling-wave motor operatively associated with the crossmember for driving the holding crossmember, the traveling-wave motor having a first traveler and a second traveler for mounting the holding crossmember, and a spring suspension movably mounting the holding crossmember to the first and second travelers, the holding crossmember being connected articulatedly to the first traveler at the first end and being connected articulatedly to the second traveler at the second end.

With the objects of the invention in view, in combination with a printing machine for processing printing material sheets, there is also provided a an apparatus for transporting a printing material sheet including a holding crossmember for holding the printing material sheet, a traveling-wave motor operatively associated with the crossmember for driving the holding crossmember, the traveling-wave motor having a first traveler and a second traveler for mounting the holding crossmember, and a spring suspension movably mounting the holding crossmember to the first and second travelers.

With the objects of the invention in view, in combination with a printing machine for processing printing material sheets, there is also provided an apparatus for transporting a printing material sheet including a holding crossmember for holding the printing material sheet, the holding crossmember being a sheet gripper bar having first and second ends, a traveling-wave motor operatively associated with the crossmember for driving the holding crossmember, the traveling-wave motor having a first traveler and a second traveler for mounting the holding crossmember, and a spring suspension movably mounting the holding crossmember to the first and second travelers, the holding crossmember being connected articulatedly to the first traveler at the first end and being connected articulatedly to the second traveler at the second end.

By such a spring suspension, the overall system including the two travelers and the holding crossmember is provided with a pre-stress that ensures that the overall system automatically assumes a defined position in the event of an accident. This defined position is characterized in that the traveler and the holding crossmember are located substantially on a line of alignment that is perpendicular to the direction of movement of the traveling-wave motor. In other words, the spring suspension prevents the holding crossmember from getting into an excessively skewed position and, as a result, into a risk of collision in the event of an accident. The accident mentioned can arise from the fact, for example, that the forward drive force acting on one of the two travelers decreases or even fails so that, as a consequence, a lead of the other traveler relative to the traveler affected by the defect occurs. Because of the mutually different speeds of the traveler of the intact side of the traveling-wave motor and the traveler on the defective side of the traveling-wave motor, the holding crossmember disposed between the travelers could get into an excessively skewed position without the countermeasure according to the invention—the spring suspension. However, in such an accident, the spring suspension effects automatic self-alignment of the overall system and the opposing position of one traveler relative to the other traveler is substantially preserved.

An additional advantage of the apparatus according to the invention is to be seen in the fact that, in the case of the latter, in spite of the technical measures provided for the accident, an articulated connection of the holding crossmember to the travelers is possible and, as a result, the preconditions for a diagonal register adjustment of the holding crossmember are provided.

Developments of the apparatus according to the invention that are advantageous from various points of view are possible.

In accordance with another feature of the invention, the spring suspension is formed by a sprung flexible joint, through which the holding crossmember is connected to the first traveler. In such a case, at an end of the holding crossmember opposite the flexible joint, the holding crossmember can be connected to the second traveler through a joint, preferably, a rotary joint.

In accordance with a further feature of the invention, provision can, therefore, be made for the holding crossmember to be connected in an articulated manner to the first traveler at its one end and to be connected in an articulated manner to the second traveler at its other end.

In accordance with an added feature of the invention, the holding crossmember is connected to the first traveler through a first rotary joint, is connected in a rotationally articulated manner to the second traveler, and is loaded by a spring forming the spring suspension. In such a case, the holding crossmember can be connected through a second rotary joint to a coupler, which is connected to the second traveler through a third rotary joint.

In accordance with an additional feature of the invention, the spring suspension is associated with at least one stop for limiting a spring travel of the spring suspension.

In accordance with yet another feature of the invention, the holding crossmember can be a vacuum bar holding the printing material sheet by the force of a vacuum. Preferably, however, the holding crossmember is a gripper bar holding the printing material sheet by a clamping force.

In accordance with a concomitant feature of the invention, a machine for processing printing material sheets, preferably, a sheet-fed press, can be equipped with the apparatus according to the invention or corresponding to one of the developments.

Other features that are considered as characteristic for the invention are set forth in the appended claims.

Although the invention is illustrated and described herein as embodied in an apparatus for transporting a printing material sheet, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
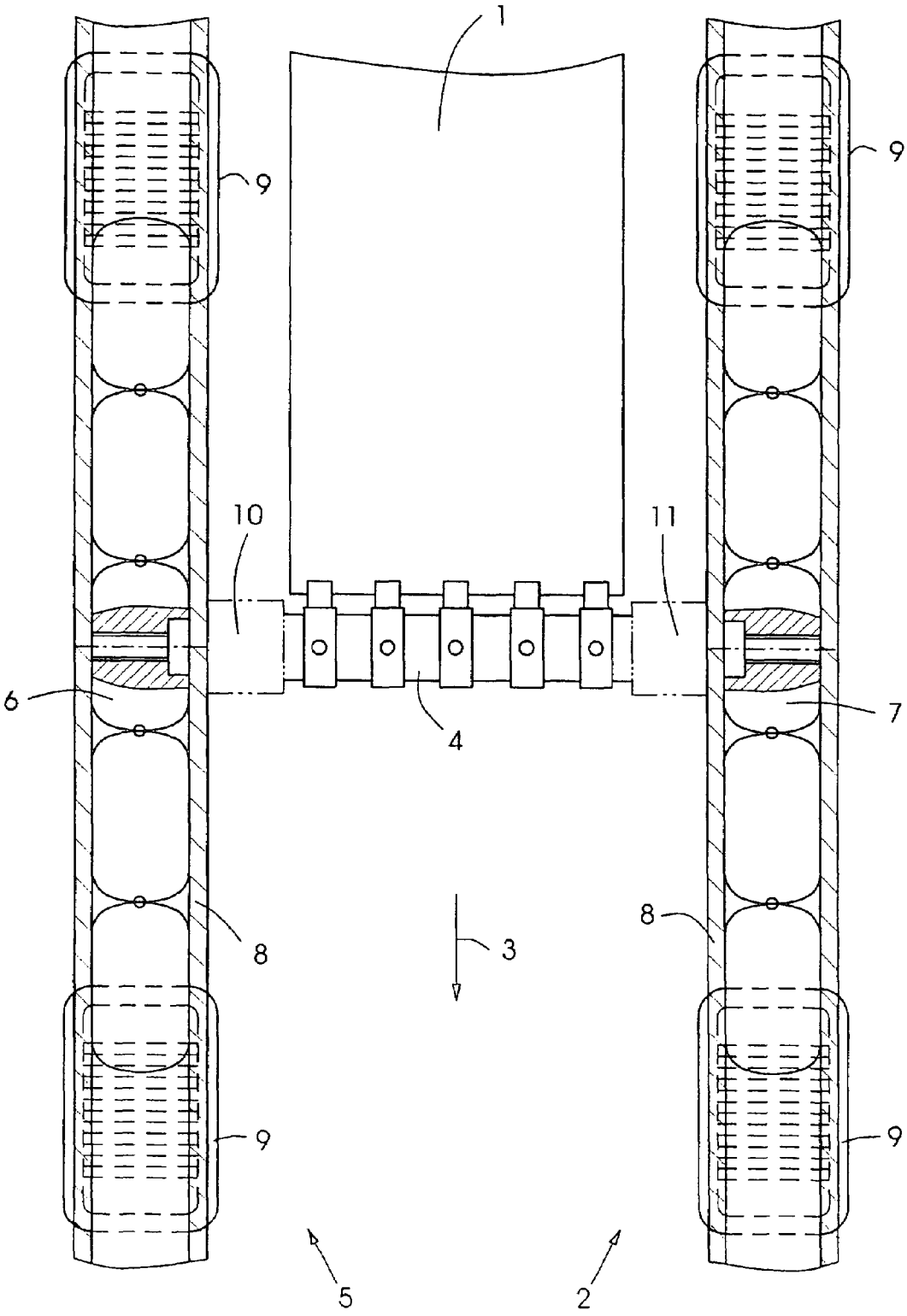
FIG. 1 is a fragmentary, plan and partially hidden view of a sheet transport apparatus according to the invention.

Referring now to the figures of the drawings in detail and first, particularly to FIG. 1 thereof, there is shown a machine 2 processing printing material sheets 1, specifically a sheet-fed press, is illustrated in an extract. The extract further shows an apparatus for transporting the printing material sheets 1.

The sheet transport apparatus includes a holding crossmember 4 that holds the respective printing material sheet 1 and drags it in a transport direction 3. The holding crossmember 4 is a gripper bar, in which the printing material sheet 1 is clamped at its leading edge.

An electromagnetic linear or traveling-wave motor 5 includes, as forward drive elements, a first traveler 6 and a second traveler 7. The motor 5 also includes mutually parallel, opposite and rail-like guides 8 for the travelers 6, 7 and also includes drive stations 9 that are associated with the guides 8 and that drive the travelers 6, 7 forward along the guides 8. The drive stations 9, which form what is referred to as the stator of the traveling-wave motor 5, are coils and generate moving electromagnetic fields, which effect the forward drive of the travelers 6, 7. The machine 2 further includes other such traveler-holding crossmember systems, which are not illustrated in the drawing and, together with the system formed by the travelers 6, 7 and the holding crossmember 4, circulate one after another along the guides 8 to transport the printing material sheets 1 one after another.

The traveling-wave motor 5, including its travelers 6, 7, guides 8, and drive stations 9, therefore, corresponds in constructional and functional terms to the traveling-wave motor described in EP 0 907 515 B1 and DE 197 48 870 A1 mentioned above. In this regard, the references EP 0 907 515 B1 are DE 197 48 870 A1 are hereby incorporated by reference herein in their entirety.

As can further be seen from FIG. 1, a first joint 10 is used to connect one end of the holding crossmember 4 to the first traveler 6, and a second joint 11 is used to connect the other end of the holding crossmember 4 to the second traveler 7. The two joints 10, 11 are indicated only schematically by phantom lines in FIG. 1 but appropriately in detail in the various exemplary embodiments in FIGS. 2 to 4.

Figure 2:
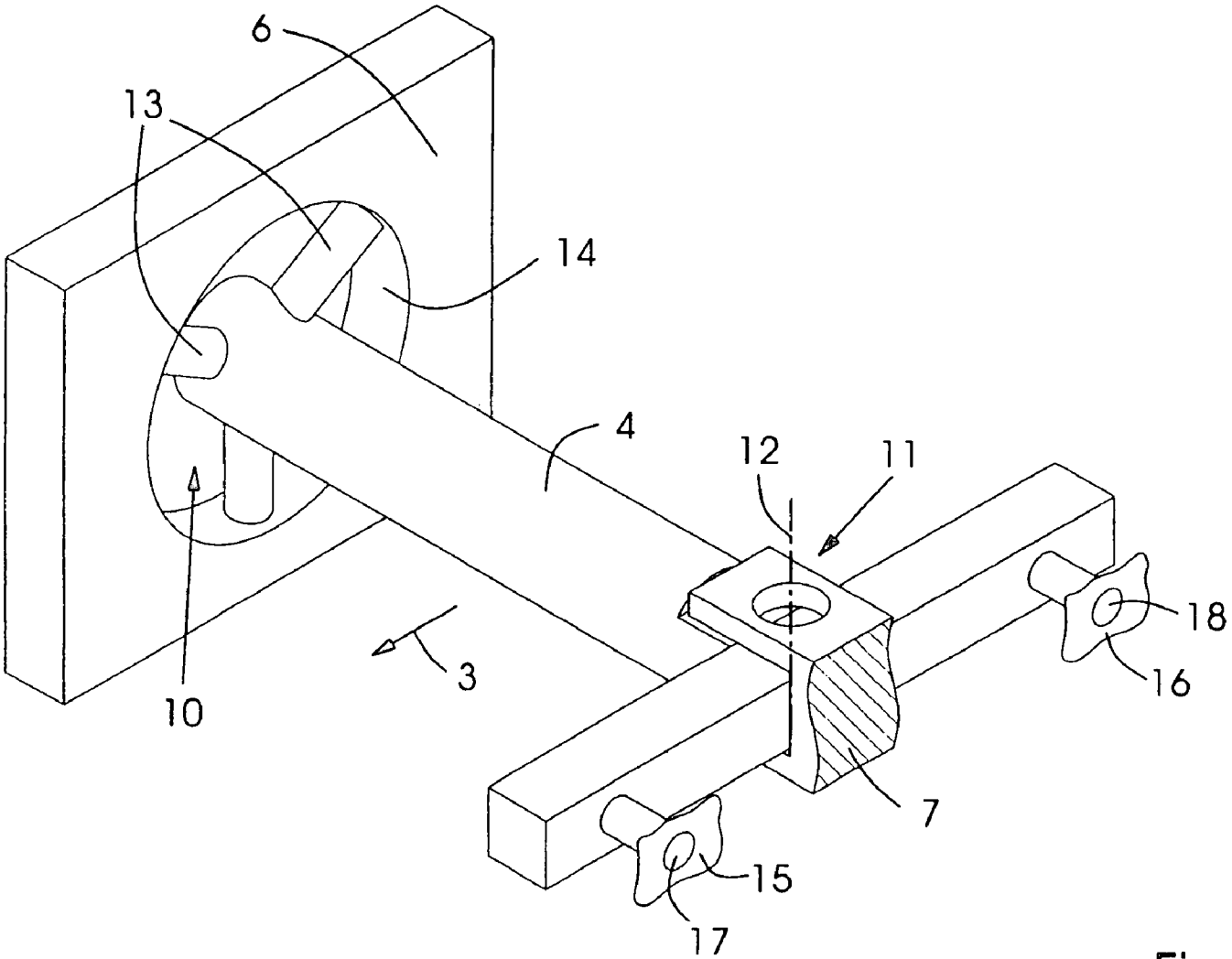
FIG. 2 is a fragmentary, perspective view of a first exemplary embodiment of a spring suspension of the sheet transport apparatus of FIG. 1.

In the exemplary embodiment according to FIG. 2, the first joint 10 is a flexible joint and the second joint 11 is a rotary joint with an axis of rotation 12 aligned at right angles to the longitudinal direction of the crossmember 4.

The first joint 10 has flexible struts 13, for example, of spring steel. The end of the holding crossmember 4 mounted through the first joint 10 projects into a recess 14, for example, a drilled recess, in the first traveler 6. This end of the holding crossmember 4 is connected to the first traveler 6 only through the flexible struts 13 and, therefore, in a yielding manner and not rigidly. The struts 13 are disposed in the shape of a star around the holding crossmember 4 so that the crossmember 4 is held centrally between the struts 13 by the struts 13. The struts 13 are transverse struts extending substantially perpendicular to the longitudinal direction of the crossmember 4. Each of the struts 13 is firmly seated with its one strut end in the traveler 6 and is firmly seated with its opposite strut end in the holding crossmember 4.

In the event of a pivoting movement of the crossmember taking place about the axis of rotation 12 of the second joint 11, the struts 13 can be deformed in accordance with the flexible rod principle. Such deformation of the struts 13 is advantageous, firstly, with regard to the setting of a diagonal register of the holding crossmember 4 and, secondly, in the event of an accident.

The elastic deformation of the struts 13 makes it possible to adjust the holding crossmember from its perpendicular alignment relative to the transport direction 3 into an alignment deviating slightly from this perpendicular alignment, that is to say, into a skewed position, and to correct the diagonal register as a result.

In the event that the drive stations 9 driving the second traveler 7 forward fail and their moving electromagnetic field is extinguished, a substantially aligned alignment of the travelers 6, 7 and of the holding crossmember 4 takes place automatically. The pre-stress associated with the elastic deformation (bending) of the sprung struts 13 has the effect of displacing the second traveler 7 affected by the defect substantially into the position opposite the first traveler 6. During such displacement, the struts 13 are relieved of stress again and the holding crossmember 4 is aligned substantially perpendicular relative to the transport direction 3.

Finally, the flexibility of the first joint 10 is also advantageous from another point of view: the flexibility makes it possible for the first joint 10 to function as an axial loose bearing of the holding crossmember 4, the second joint 11 functioning as an axial fixed bearing of the holding crossmember 4. The length changes of the holding crossmember 4 taking place in the axial or longitudinal direction of the holding crossmember 4 are compensated for by corresponding bending of the struts 13.

The spring suspension formed by the first joint 10 has a first stop 15 and a second stop 16 associated cooperatively thereto. The stops 15, 16 are disposed on the first traveler 7 and illustrated only schematically in FIG. 2. A first contact face 17 disposed on the holding crossmember 4 strikes the first stop 15 in the event of a pivoting movement of the holding crossmember 4 taking place about the axis of rotation 12 in the counterclockwise direction with respect to FIG. 2. In the event of a pivoting movement of the holding crossmember 4 taking place in the opposite direction, that is to say, in the clockwise direction with respect to FIG. 2, a second contact face 18 strikes the second stop 16. The contact faces 17, 18 can be formed, for example, by contact pins and, together with the stops 15, 16, limit the pivoting angle of the holding crossmember 4 in both possible pivoting directions.

Figure 3:
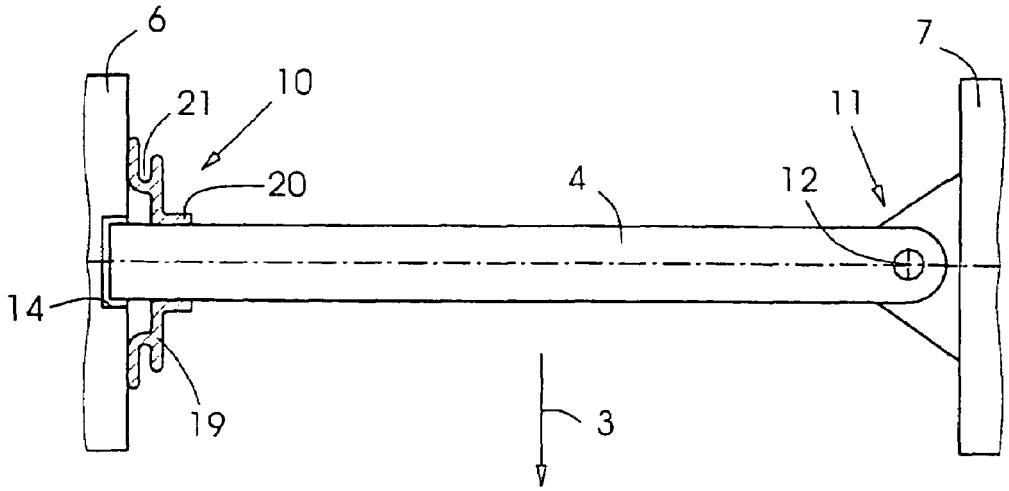
FIG. 3 is a fragmentary, perspective view of a second exemplary embodiment of a spring suspension of the sheet transport apparatus of FIG. 1.

The exemplary embodiment according to FIG. 3 represents a modification of the exemplary embodiment according to FIG. 2 and differs in constructional terms from the exemplary embodiment illustrated in FIG. 2 only in the fact that, to form the first joint 10 as a flexible joint, what is referred to as a diaphragm spring in the form of a flexible bellows 19 is provided instead of the struts 13 used according to FIG. 2.

The end of the holding crossmember 4 that is carried by the bellows 19 is seated centrally in the bellows 19 or a collar 20 belonging to the bellows 19. The bending point of the bellows 19 is defined by a bead 21 running in the form of an annular groove around the bellows 19. The bellows 19 can be produced from a spring metal plate or can be of another resilient material. The holding crossmember 4 flange-mounted on the first traveler 6 by the bellows 19 is, thus, connected to the first traveler 6 in a flexibly articulated manner and not rigidly.

The function of the bellows 19 as a spring suspension for the holding crossmember 4 substantially corresponds to the corresponding function of the struts 13 of the exemplary embodiment according to FIG. 2 and, therefore, does not need to be explained once more.

Figure 4:
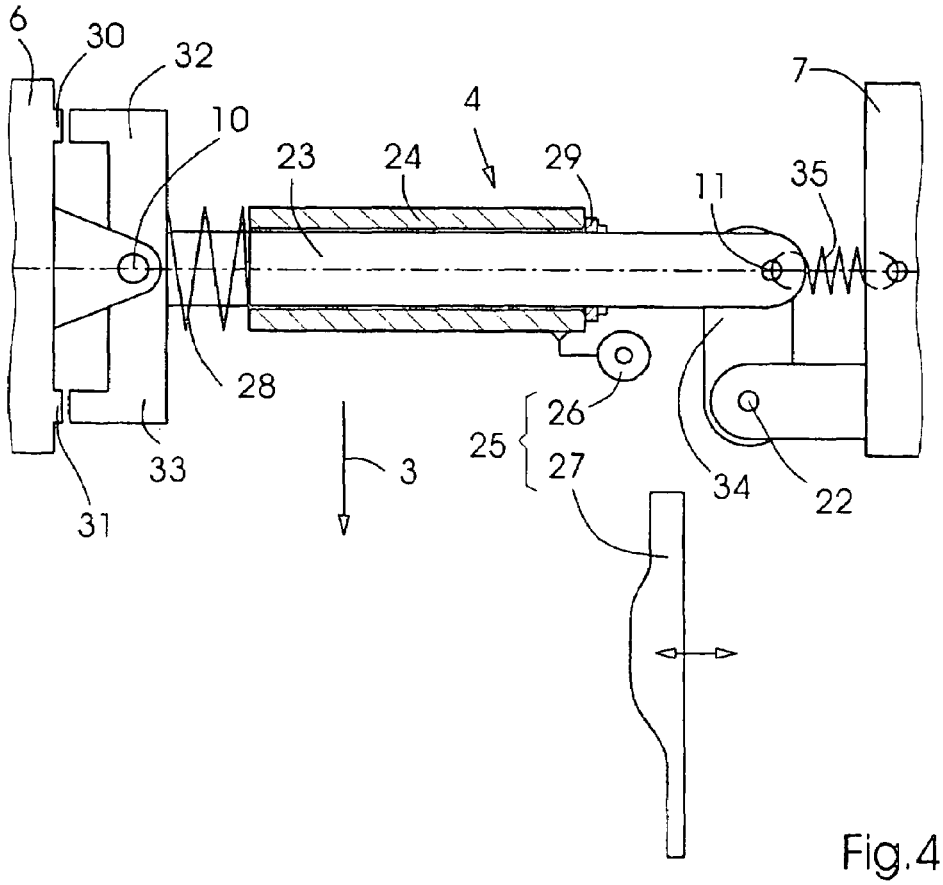
FIG. 4 is a fragmentary, perspective view of a third exemplary embodiment of a spring suspension of the sheet transport apparatus of FIG. 1.

In the exemplary embodiment according to FIG. 4, the first joint 10 is formed as a first rotary joint and the second joint 11 is formed as a second rotary joint. In addition, there is a third joint 22, which is formed as a third rotary joint.

The holding crossmember includes a rod-like inner part 23 and a hollow profiled, tubular outer part 24, which is seated on the inner part 23 such that it can be displaced axially. Grippers, not illustrated in the drawing in FIG. 4, belonging to the holding crossmember 4 are fixed into the outer part 24.

A cam mechanism 25, which includes a cam follower element 26 fixed to the outer part 24 and a cam 27 interacting with this cam element 26 is used to displace the outer part 24 axially counter to the action of a return spring 28. The helical return spring 28 (spiral spring) is seated on the inner part and attempts to displace or push the outer part 24 against an axial stop 29 disposed on the inner part 23.

Stops 30, 31 disposed on the first traveler 6 act in a manner comparable with the stops 15, 16 in FIG. 2 and, in both possible pivoting directions of the holding crossmember 4, limit the angle of its pivoting movement taking place about the first joint 10. The stops 30, 31 interact with lever arms 32, 33 on the holding crossmember 4 or its inner part 23.

The inner part 23 is coupled through the second joint 11 to a coupler 34, which is connected to the second traveler 7 through the third joint 22. Disposed between the second traveler 7 and the coupler 34 is a spring 35 that can be loaded in tension and that attempts to pivot the coupler 34 away around the third rotary joint 22.

Both the return spring 28 and the spring 35 form a spring suspension used to mount the holding crossmember 4. The axial stop 29 is used to limit the spring travel of the return spring 28. The stops 30, 31 are used to limit the spring travel of the spring 35.

This application claims the priority, under 35 U.S.C. § 119, of German patent application No. 103 45 331.8, filed Sep. 30, 2003; the entire disclosure of the prior application is herewith incorporated by reference.

We claim:

1. An apparatus for transporting a printing material sheet, comprising:

a holding crossmember for, holding the printing material sheet;

a traveling-wave motor operatively associated with said crossmember for driving said holding crossmember, said traveling-wave motor having a first traveler and a second traveler for mounting said holding crossmember;

a spring mounted on said first traveler and on said holding crossmember, said spring defining a flexible joint for movably mounting said holding crossmember to said first and second travelers; and a second joint connecting said holding crossmember to said second traveler.

2. The apparatus according to claim 1, wherein said spring is a sprung flexible joint connecting said holding crossmember to said first traveler.

3. The apparatus according to claim 1, wherein said second joint is a rotary joint.

4. The apparatus according to claim 1, further comprising:

a first rotary joint connecting said holding crossmember to said first traveler;

said holding crossmember being connected to said second traveler in a rotational articulation; and said spring suspension is a spring loading said holding crossmember.

5. The apparatus according to claim 4, further comprising:

a coupler;

a second rotary joint connecting said holding crossmember to said coupler; and a third rotary joint connecting said coupler to said second traveler.

6. The apparatus according to claim 1, wherein:

said holding crossmember has first and second ends;

said holding crossmember is connected articulatedly to said first traveler at said first end; and said holding crossmember is connected articulatedly to said second traveler at said second end.

7. The apparatus according to claim 1, further comprising at least one stop associated with said spring suspension and limiting a spring travel of said spring suspension.

8. The apparatus according to claim 1, wherein said holding crossmember is a gripper bar.

9. The apparatus according to claim 1, wherein said spring is a diaphragm spring.

10. The apparatus according to claim 9, wherein said diaphragm spring is a flexible bellows.

11. An apparatus for transporting a printing material sheet, comprising:

a holding crossmember for holding the printing material sheet, said holding crossmember being a sheet gripper bar having first and second ends;

a traveling-wave motor operatively associated with said crossmember for driving said holding crossmember, said traveling-wave motor having a first traveler and a second traveler for mounting said holding crossmember;

a spring mounted on said first traveler and on said holding crossmember, said spring defining a flexible joint for movably mounting said holding crossmember to said first and second travelers; and a second joint connecting said holding crossmember to said second traveler;

said holding crossmember being connected articulatedly to said first traveler at said first end and being connected articulatedly to said second traveler at said second end.

12. In combination with a printing machine for processing printing material sheets, an apparatus for transporting a printing material sheet comprising:

a holding crossmember for holding the printing material sheet;

a traveling-wave motor operatively associated with said crossmember for driving said holding crossmember, said traveling-wave motor having a first traveler and a second traveler for mounting said holding crossmember;

a spring mounted on said first traveler and on said holding crossmember, said spring defining a flexible joint for movably mounting said holding crossmember to said first and second travelers; and a second joint connecting said holding crossmember to said second traveler.

13. In combination with a printing machine for processing printing material sheets, an apparatus for transporting a printing material sheet comprising:

a holding crossmember for holding the printing material sheet, said holding crossmember being a sheet gripper bar having first and second ends;

a traveling-wave motor operatively associated with said crossmember for driving said holding crossmember, said traveling-wave motor having a first traveler and a second traveler for mounting said holding crossmember;

a spring mounted on said first traveler and on said holding crossmember, said spring defining a flexible joint for movably mounting said holding crossmember to said first and second travelers; and a second joint connecting said holding crossmember to said second traveler;

said holding crossmember being connected articulatedly to said first traveler at said first end and being connected articulatedly to said second traveler at said second end.

* * * * *